US005462614A

United States Patent [19]

Sawada et al.

[11] Patent Number: 5,462,614

[45] Date of Patent: Oct. 31, 1995

[54] METHOD OF PRODUCING SUPPORT FOR PLANOGRAPHIC PRINTING PLATE

[75] Inventors: Hirokazu Sawada; Akio Uesugi; Masaya Matsuki, all of Shizuoka, Japan

[73] Assignee: Fuji Photo Film Co., Ltd., Kanagawa, Japan

[21] Appl. No.: 207,163

[22] Filed: Mar. 8, 1994

[30] Foreign Application Priority Data

Mar. 9, 1993 [JP] Japan ..... 5-072842
Nov. 1, 1993 [JP] Japan ..... 5-293834

[51] Int. Cl.[6] ..... C22F 1/04

[52] U.S. Cl. ..... 148/551; 148/695; 148/696; 148/437; 164/476; 164/477

[58] Field of Search ..... 148/551, 695, 148/696, 437; 164/476, 477

[56] References Cited

U.S. PATENT DOCUMENTS 5,078,805 1/1992 Uesugi et al. ..... 148/551

FOREIGN PATENT DOCUMENTS 0223737 5/1987 European Pat. Off. .
0292411 11/1988 European Pat. Off. .
0576170 6/1992 European Pat. Off. .
0581321 2/1994 European Pat. Off. .
54-065607 5/1979 Japan .
55-142695 11/1980 Japan .
60-005861 1/1985 Japan .
62-148295 7/1987 Japan .
63-230856 9/1988 Japan .
1-237197 9/1989 Japan .
4-033707 2/1992 Japan .

*Primary Examiner*—David A. Simmons
*Assistant Examiner*—Robert R. Koehler
*Attorney, Agent, or Firm*—Sughrue, Mion, Zinn, Macpeak & Seas

[57] ABSTRACT

A method of producing a support for a planographic printing plate, which reduces the scattering in the material of the aluminum support, improves the yield of the electrolytic surface graining treatment, and is able to produce lithographic printing plates having superior surface graining aptitude. Aluminum material with a width of 1000 mm and a thickness of 6 mm is formed in the continuous casting twin-roller thin plate device. It is then cold rolled to a plate thickness of 3 mm, and after conducting annealing at 400° C., cold rolling (including correction) is further conducted to bring it to 0.3 mm and form the samples. The temperature distribution of the molten metal at the outlet of the molten metal supply nozzle is kept within a predetermined range.

13 Claims, 3 Drawing Sheets

METHOD OF PRODUCING SUPPORT FOR PLANOGRAPHIC PRINTING PLATE

BACKGROUND OF THE INVENTION a) Field of the Invention

The present invention relates to a method of producing a support for a planographic printing plate, and, in particular, to a method of producing an aluminum support which is superior in an electrolytic ally graining property.

b) Related Art

Aluminum plate (including aluminum alloy plates) is used as a printing plate support, and particularly as offset printing plate support.

Generally, in order to use an aluminum plate as an offset printing plate support, it is necessary that the aluminum plate has the proper degree of adhesion with photosensitive material and moisture retention.

For this purpose, the surface of the aluminum plate must be uniformly and finely grained. Since this surface graining treatment exercises a remarkable influence on the printing performance and print durability of the plate material when offset printing is actually conducted after plate preparation, its quality is an important factor in the manufacture of plate material.

As a surface roughening method for the aluminum support used for the printing plate, the alternating current electrolytic graining method is commonly used, and as the electric current, ordinary sinewave current, or special alternating wave form current such as square wave are used. Surface graining treatment of the aluminum plate is conducted by means of alternating current using a suitable electrode of graphite, etc. as the opposite electrode, and the treatment is usually conducted once, but the pit depth obtained in this manner is generally shallow, and print durability has been inferior. As a result, numerous methods have been proposed for purposes of obtaining a suitable aluminum plate as a support for planographic printing plate which has a grain where the pits are uniform and fine with a depth which is deep compared with the diameter. As conventional examples of such methods, there is the surface graining method which uses special wave form for electrolytic treatment (Japanese Patent Unexamined Publication No. Sho-53-67507), the special ratio between electricity quantity of a positive period and that of negative period at the time of alternating electrolytic surface graining (Japanese Patent Unexamined Publication No. Sho-54-65607), special wave form (Japanese Patent Unexamined Publication No. Sho-55-25381), the combination of current density (Japanese Patent Unexamined Publication No. Sho-56-29699), etc.

In addition, combining with mechanical surface graining (Japanese Patent Unexamined Publication No. Sho-55-142695) is also known.

On the other hand, as the producing method for aluminum supports, an aluminum ingot (and alloy additive) is retained in a melted state and cast into a slab (400 to 600 mm thickness, 1000 to 2000 mm width, 2000 to 6000 mm length); after passing through a surface cutting process in which a planing machine is applied to the structurally impure parts of the slab surface to cut away the parts by 3 to 10 mm, a soaking treatment process is conducted in which the slab is maintained in a soaking pit at 480° C. to 540° C. for 6 to 12 hours for purposes of removing stress from the slab interior and making its structure uniform. Thereafter, hot rolling is conducted at 480° C. to 540° C. After the slab has been rolled to a thickness of 5 to 40 mm in hot rolling, cold rolling is conducted at room temperature to a predetermined thickness. Subsequently, annealing is conducted in order to make the structure uniform, and after the rolled structure has been homogenized, cold rolling is conducted to a predetermined thickness, and correction is conducted to obtain a plate with a good degree of flatness. The aluminum plates obtained in this manner have been used as a support for a planographic printing plate.

Yet, in the case of electrolytic surface graining treatment, the aluminum support which becomes the object of treatment is particularly easily influenced. In the case where the aluminum support is manufactured through processes of melting and holding, casting, surface cutting and soaking in this order or manner, there occurs scattering in the metal alloy components in the surface layer which lead to a drop in the yield of the planographic printing plate, even if heating and cooling are repeated and surface layers are scraped off in surface cutting.

To cope with this, U.S. Pat. No. 5,078,805 which corresponds to Japanese Patent Unexamined Publication No. Hei-3-79798 proposes a method capable of producing lithographic printing plates of superior quality and good yield by reducing the scattering in the material of the aluminum support and improving the yield of the electrolytic surface graining treatment.

In the former method of producing a support for planographic printing plate, casting and hot rolling processes are continuously conducted to form from a molten aluminum a thin plate of hot-rolled coil, and thereafter cold rolling, heat treating and correction are conducted to obtain an aluminum support. Then, the aluminum support thus obtained is subjected to the surface graining.

In the latter method of producing a support for planographic printing plate, the continuous casting and rolling processes are conducted using common twin rollers to directly form the plate from molten aluminum. Subsequently, cold rolling and heat treatment are conducted, and surface graining treatment is performed on the aluminum support which has undergone correction.

Yet, with regard to the former producing method, some components of the aluminum support causes scattering in the yield of the electrolytic surface graining treatment and in the surface graining aptitude. Further, even using the latter producing method, there is a defect that external appearance becomes poor due to the generation of streaks and creased/granular irregularities on the treated surface which has undergone surface graining.

SUMMARY OF THE INVENTION

Accordingly, it is an object of the present invention to provide a method of producing a support for planographic printing plate which reduces the scattering in the material of the aluminum support, improves the yield of the electrolytic surface graining treatment, and is able to produce planographic printing plates having superior surface graining aptitude.

Another object of the present invention is to provide a method of producing a support for planographic printing plate, which is able to produce planographic printing plates exhibiting good surface properties after surface graining, with superior external appearance and without the generation of streaks and creased/granular irregularities.

As a result of diligent research into the relation between aluminum support and electrolytic surface graining treatment, the present inventors arrived at the present invention.

In order to attain the above-mentioned and other objects, the present invention provides a method of producing a support for a planographic printing plate comprising the steps of supplying molten aluminum to a mold from a molten metal supply nozzle, casting the molten aluminum into tabular aluminum, rolling and heat treating the tabular aluminum into an aluminum support, correction of the aluminum support, and then graining a surface of the aluminum support. In the method, a temperature distribution of the molten metal in the molten metal supply nozzle is made so as not to vary by more than a predetermined temperature range or difference, e.g. 30° C., at a tip end of the nozzle.

In the present invention, as the method for producing an aluminum ingot from molten aluminum using, for example, a fixed mold, casting techniques such as the DC method have been put into practical use. As a method which uses a drive mold, a method which uses a cooling belt, such as the Hazlay method, or a method which uses a cooling roller, such as the Hunter method and the 3C method, may be used. Moreover, methods which fabricate a coiled thin plate are disclosed in Japanese Patent Unexamined Publication No. Sho-60-238001, Japanese Patent Unexamined Publication Sho-60-240360, etc.

With regard to the present invention, it is essential that the molten metal temperature distribution of the molten metal supply nozzle be maintained within a fixed range at the nozzle tip. In the case where a pair of cooling rollers are used for the casting method, in order to obtain an aluminum alloy plate with better surface graining aptitude, it is preferable that the reduction force due to the cooling rollers be kept at above 30 tons per 1 m of plate width.

In this manner, it is possible to manufacture at low cost and with good yield a support for planographic printing plate with superior surface graining.

Further, the present invention provides a method of producing a support for a planographic printing plate comprising the steps of continuous cast-rolling molten aluminum so as to directly form a plate from the molten aluminum, cold-rolling and heat-treating the plate to obtain an aluminum support, correction of the aluminum support, and surface-graining the aluminum support. In the method, a thin plate of 4 to 30 mm thick is produced by the continuous casting, and the thickness is reduced by 60% to 95% by the cold-rolling. Subsequently, annealing is conducted at a temperature raising rate not less than 50° C./sec and an annealing temperature of 400° C. to 650° C. as the heat-treating, and further a second annealing is conducted at a temperature raising rate not more than 10° C./sec. Then, thickness is reduced to 0.1 to 1.0 mm by finish rolling.

In the present invention, as the method which conducts continuous casting of the molten aluminum directly into a plate form, and which forms coiled of thin plate, thin plate casting techniques such as the Hunter method, the Hazlay method, and the Alswisscaster II method have been put into practical use.

First, a thin plate of 4 to 30 mm is produced by continuous casting. Next, the thickness is reduced 60% to 95% by cold rolling, after which annealing is conducted by the heat treatment process at a temperature raising rate not less than 50° C./sec and an annealing temperature of 400° C. to 650° C. A second annealing is then conducted at a temperature raising rate not more than 10° C./sec. Finally, it is again processed in the cold rolling machine where its thickness is reduced to 0.1 mm to 1.0 mm, after which it is processed in the correction device to obtain a plate with a good degree of flatness.

It is preferable that a molten aluminum is supplied to the continuous casting device in such a manner that a temperature distribution of the molten metal or aluminum in a molten metal supply nozzle is made so as not to vary by more than a predetermined temperature range or difference, e.g. 30° C., at a tip end of the nozzle.

BRIEF DESCRIPTION OF THE DRAWINGS

In the accompanying drawings:

FIGS. 6A to 6E are conceptual diagrams showing an another embodiment of the present invention, wherein FIG. 6A shows a casting step, FIG. 6B shows a cold-rolling step, FIG. 6C shows a heat treatment step under a high temperature raising rate, FIG. 6D shows a heat treatment step under a low temperature raising rate, and FIG. 6E shows a correction step (E).

DETAILED DESCRIPTION OF THE PREFERRED EMBODIMENTS

Figure 1:
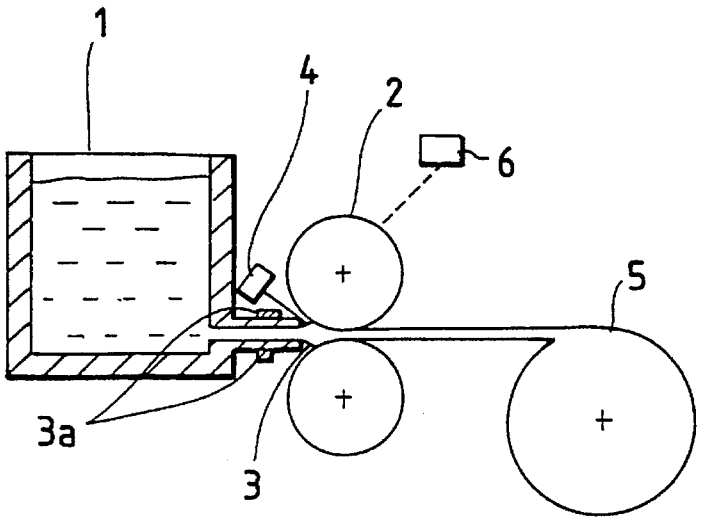
FIG. 1 is a conceptual diagram showing a casting process in an embodiment of the present invention.

A production method for aluminum support according to an embodiment of the present invention will be explained more specifically with reference to FIGS. 1 and 2. The reference numeral 1 is a melting and holding furnace in which an ingot and alloy additive are retained in a melted state.

From here, the molten aluminum is sent from a molten metal supply nozzle 3 to a twin-roller continuous casting machine 2. At this time, in order to have the temperature distribution in the plate width direction at the tip of the molten metal supply nozzle fall within a predetermined temperature range, the temperature is continuously measured by a thermometer 4 and controlled with the heating elements 3*a* which are provided in a segmented manner in the widthwise direction of the nozzle. It is preferable that the temperature distribution, i.e a difference in temperature in the plate width direction at the tip of the molten metal supply nozzle does not vary more than 30° C. In the embodiment, with the twin-roller continuous casting machine 2 thin plates of 4 to 30 mm thickness are directly formed from the molten aluminum. On this occasion, good results are obtained when the reduction force due to the twin rollers are kept above 30 tons per 1 m of plate width. This rolling reduction force is measured by a rolling force measuring device 6.

Figure 3:
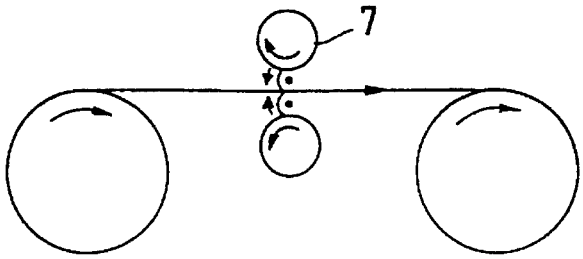
FIG. 3 is a conceptual diagram showing a cold rolling process in the embodiment of the present invention.
Figure 4:
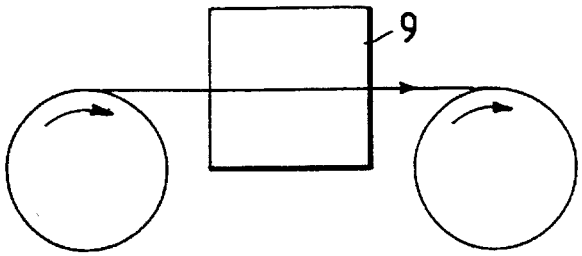
FIG. 4 is conceptual diagram showing a hot rolling process in the embodiment of the present invention.
Figure 5:
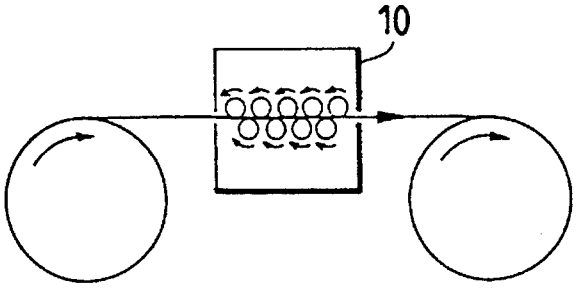
FIG. 5 is a conceptual diagram showing a correction device used in the embodiment of the present invention.

After being wound on a coiler 5, the thin aluminum plate is subjected to a cold rolling machine 7, a heat treatment process 9, and a correction device 10 which are respectively shown in FIG. 3, FIG. 4, and FIG. 5, so that an aluminum support is produced.

A similar production process is followed in the case where a pair of cooling rollers are not used in the mold, but rather a drive mold such as a belt, or a fixed mold is used. That is, based on the results of the molten metal temperature measurement at the nozzle outlet with regard to the temperature distribution in the molten metal supply nozzle, the heating elements 3*a* which are provided in a segmented manner in the widthwise direction of the nozzle are controlled, and the temperature is kept within 30° C. Thereafter, hot rolling is conducted to obtain an aluminum plate which is then successively subjected to the cold rolling machine 7, the heat treatment process 9, and the correction device 10 as shown in FIG. 3, FIG. 4, and FIG. 5, respectively.

Next, the process conditions are explained in further detail. In the melting and holding furnace 1, it is necessary to maintain the temperature above the melting point of aluminum, and the temperature is changed in a timely manner according to the aluminum alloy components. In general, it is above 800° C.

In order to inhibit the generation of oxides in the molten aluminum and to remove alkaline metals which are harmful to product quality, inert gas purge, flux treatment, and so on, may be conducted appropriately.

Next, casting is conducted by a casting machine such as the twin-roll continuous casting machine 2 via the molten metal supply nozzle. At this time, the molten metal temperature at the outlet of the molten metal supply nozzle is measured. Based on the measurement results, the heating elements 3*a* provided in a segmented manner, each of which extends in the axial direction of the nozzle, are controlled so that the temperature distribution falls within 30° C.

There are various casting methods. For example, with a fixed mold, there is the DC method; with a drive mold, there are the Hazlay method which uses a belt, and the Hunter method and 3C method which use rollers.

The casting temperature varies according to the method and the alloy, but is in the neighborhood of 700° C. In the case where the Hunter method or 3C method is adopted, the molten metal is coagulated and rolling can be conducted between the two rolls. At this time, it is preferable that the rolling force be kept above 30 tons per 1 m of plate width.

The plate material obtained in case of casting with the DC method and the Hazlay method is rolled to the prescribed thickness by the hot rolling machine (not illustrated in FIGS. 1 to 5) and the cold rolling machine 7. At this time, the heat treatment process 9 of intermediate annealing is conducted in order to make the size of the crystal grains uniform, and the operation of the cold rolling machine 7 may be further provided. Next, correction is conducted by the correction device 10 to obtain the predetermined flatness, thus producing the aluminum support which is then subjected to surface graining. Alternatively, correction is conducted in such a way that it is included in the final cold rolling.

Figure 6A:
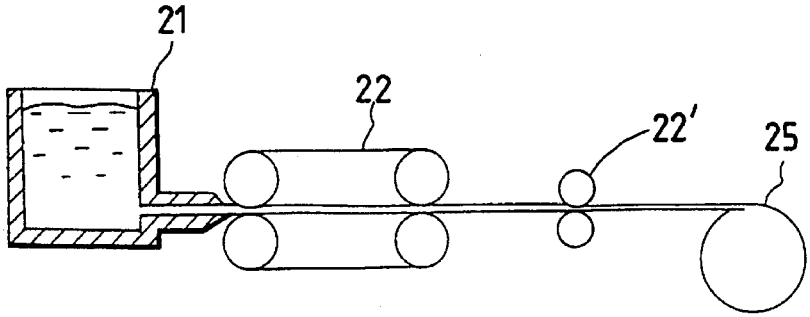
Figure 6B:
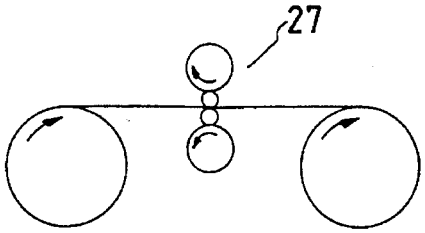
Figure 6C:
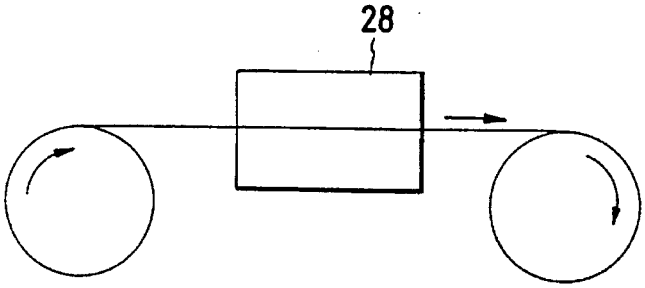
Figure 6D:
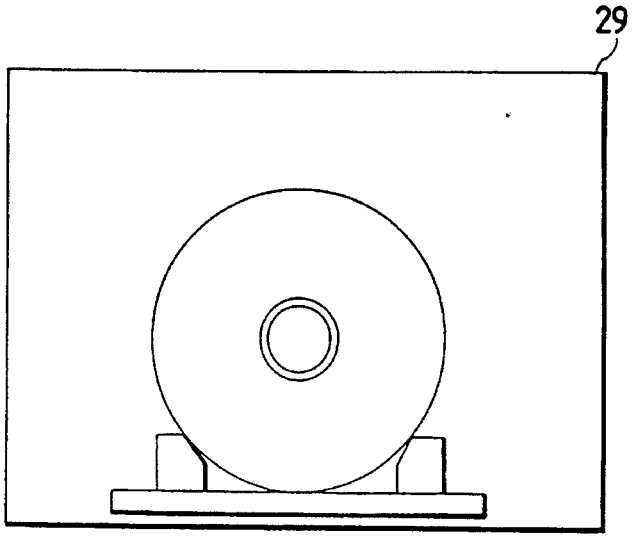
Figure 6E:
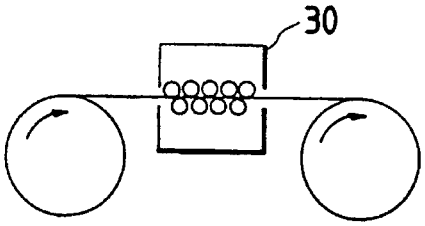

A manufacturing method for aluminum support according to another embodiment of the present invention is explained in detail with reference to FIGS. 6A to 6E. In FIG. 6A, the reference numeral 21 is a melting and holding furnace which maintains an aluminum alloy in a melted state. From here, the ingot is sent to a hot rolling machine 22' via a twin-belt continuous casting device 22. In short, a hot rolled coil of thin plate of 4 to 30 mm is directly formed from molten aluminum, and is wound up by the coiler 25. In the case where a twin-roll continuous casting device is used, the thin plate can be directly formed without passing through the hot rolling machine. Thereafter, the coiled thin plate is put into the cold rolling machine 27 of FIG. 6B where its thickness is reduced by 60% to 95%, after which it is sent to the induction heating annealing device 28 of FIG. 6C for a heat treatment process with a high temperature raising rate, where annealing is conducted at an annealing temperature of 400° C. to 650° C. and a temperature raising rate not less than 50° C./sec. A second annealing is then conducted at a temperature raising rate not more than 10° C./sec by the heat treatment process 29 of FIG. 6D, after which the plate is again sent to the cold rolling machine 27 for final rolling where the thickness is reduced to 0.1 to 1.0 mm. In addition, the plate passes through the correction device 30 of FIG. 6E. Surface graining treatment is performed on the plate material obtained in this manner. The heat treatment process of FIG. 6D is an example of the batch method, but the invention is not limited thereto, and alternatively, the coiled material may be continuously subjected to heat treatment using a gas furnace.

Next, casting is conducted by the twin-belt continuous casting device 22. There are various casting methods, but it is mainly the Hazlay method and the Alswisscaster II method which are used in current industrial operations. The casting temperature varies according to the method and alloy, but is in the neighborhood of 700° C. In the case where the Hazlay method or the Alswisscaster II method is adopted, the molten metal is coagulated. In the case where the twin-roll continuous casting device is used, the Hunter method or the 3C method can be adopted. With regard to the plate material obtained at this stage, when the distribution of elements of a cross-section is observed by an electron probe microanalyzer (hereinafter referred to as "EPMA"), the distribution of elements in the depthwise and widthwise directions are both irregular, which leads to the defect of irregular surface graining in the final product. Thereupon, the thickness of the continuously cast thin plate is reduced by 60% to 95% by the cold rolling machine 27. At this point, when the distribution of elements in the surface is observed by EPMA, the elementary analysis is irregular in a form extending in the roll direction, and when the crystal macrostructure of the surface is observed, there are also found to be crystals elongated in the roll direction, which leads to the defect that creased irregularities and streaks become conspicuous after treatment. Thus, in order to regularize the crystal grain size, annealing is conducted at a temperature raising rate not less than 50° C./sec and an annealing temperature of 400° C. to 650° C., and to further regularize the distribution of elements, a second annealing is conducted at a temperature raising rate not more than 10° C./sec. Thereafter, thickness is further reduced to 0.1 mm to 1.0 mm by finish rolling to produce a thin plate, and correction is conducted by the correction device 30.

With regard to the method of surface graining of the support for a planographic printing plate obtained in accordance with the present invention, various types such as mechanical surface graining, chemical surface graining, electrochemical surface graining, or a combination of these may be used.

As the mechanical graining method, there are, for example, the ball graining, wire graining, brush graining, and liquid honing methods. As the electrochemical graining method, the alternating current electrolytic etching method is generally applied, and as the electric current, an ordinary sinusoidal current, or a special alternating current such as square wave are used. Moreover, as pre-treatment for this electrochemical graining, etching treatment using caustic soda may be used.

In the case where electrochemical surface graining is conducted, it is best to perform surface graining by means of an alternating current and with an aqueous solution whose main component is a hydrochloric acid or a nitric acid. This is explained in detail below.

First, alkali etching is conducted on the aluminum support. The preferred alkali agents are caustic soda, caustic potash, metasilicate soda, sodium carbonate, aluminate soda, gluconic soda, etc. It is appropriate to select from a range of 0.01% to 20% concentration, 20° C. to 90° C. temperature, and 5 seconds to 5 minutes time; the preferred etching quantity is 0.01 to 5 g/m$^2$.

Particularly in the case of a support with a large amount of impurities, 0.01 to 1 g/m$^2$ is appropriate (Japanese Patent Unexamined Publication No. Hei-1-237197). Next, since there remains material (smut), which is insoluble in alkali, on the surface of the aluminum plate which has undergone alkali etching, desmut treatment may be conducted according to necessity.

After performing pretreatment in the above manner, alternating current electrolytic etching is conducted in the present invention in an electrolyte containing a hydrochloric acid or a nitric acid as its main component. The frequency of the alternating current electrolytic current is 0.1 to 100 Hz, and more preferably 0.1 to 1.0 or 10 to 60 Hz. The solution concentration is 3 to 150 g/l, and more preferably 5 to 50 g/l. As the amount of dissolved aluminum in the bath, below 50 g/l is appropriate, and 2 to 20 g/l is more preferable. Additives may be inserted according to necessity, but in the case of mass production, control of the solution concentration becomes difficult.

With regard to the current density, 5 to 100A/dm$^2$ is appropriate, and 10 to 80A/dm$^2$ is more preferable. Power source wave form is selected at the appropriate time according to the desired product quality and the composition of the aluminum support which is used, but use of the special alternating wave form disclosed in Japanese Patent Unexamined Publication No. Sho-56-19280 and Japanese Patent Unexamined Publication No. Sho-55-19191 is more preferable. These wave form and solution conditions are selected in a timely manner based on the quantity of electricity, the desired product quality, and the composition of the aluminum support which is used.

The aluminum which has undergone electrolytic surface graining is next dipped in an alkali solution as part of smut treatment, and the smut is dissolved away. As the alkali agent, there are various types such as caustic soda, but it is preferable to conduct the treatment at a PH of above 10, a temperature of 25° C. to 60° C., and an extremely short time of 1 to 10 seconds as the dip time.

Next, it is dipped into a solution containing a sulfuric acid as its main component. As the solution conditions for the sulfuric acid, a concentration of 50 to 400 g/l, which is somewhat lower than the conventional one, and a temperature of 25° to 65° C. are preferable. When the sulfuric acid concentration exceeds 400 g/l or the temperature exceeds 65° C., the corrosion of the treatment tank becomes large, and in the case of an aluminum alloy having more than 0.3% of manganese, the grain which has undergone electrochemical surface graining is destroyed. Moreover, when etching is conducted so that the dissolved quantity of the aluminum substrate is more than 0.2 g/m$^2$, print resistance is reduced; it is therefore preferable to keep it at below 0.2 g/m$^2$.

It is good to form an anodic oxide coating of 0.1 to 10 g/m$^2$, and more preferably 0.3 to 5 g/m$^2$, on the surface.

Since the treatment conditions for anodic oxide vary in various ways according to the electrolyte which is used, they cannot be decided unconditionally, but generally it is appropriate to have an electrolyte concentration of 1 to 80 weight %, a temperature of 5° to 70° C., a current density of 0.5 to 60A/cm$^2$, a voltage of 1 to 100V, and an electrolysis time of 1 second to 5 minutes.

The grained aluminum plate which has an anodic oxide coating and which is obtained in this manner is itself stable and has superior hydrophilic properties. Consequently, a photosensitive paint film can immediately be provided on top, however, further surface treatment can be performed as necessary.

For example, a silicate layer derived from the alkali metal silicate described above, or an undercoating consisting of a hydrophilic macromolecular compound can be provided. With regard to the paint application quantity of the undercoating, 5 to 150 mg/m$^2$ is preferable.

Next, after the photosensitive coating layer has been provided on the aluminum support which has been processed in this manner, and after image exposure and developing have been conducted to prepare the printing plate, it is set in a printing machine, and printing is commenced.

EXAMPLES

EXAMPLE 1

Aluminum plate material of 1000 mm width and 6 mm thickness was formed in the continuous casting twin-roller thin plate device shown in FIG. 1. It was then cold rolled to a plate thickness of 3 mm, and after conducting annealing at 400° C., cold rolling (including correction) was further conducted to bring it to 0.3 mm and form the sample.

At this time, the heating conditions of the heating elements provided in the widthwise direction along the nozzle were appropriately adjusted so that the temperature distribution range at the molten metal supply nozzle outlet fell within 30° C., and exceeded 30° C., and the supports were respectively manufactured as Examples 1, 2 and 3, and comparative Examples 1, 2 and 3. The temperature distribution at the nozzle outlet was measured using a thermocouple. Moreover, measurement of the rolling force applied to the twin rolls during continuous casting was conducted at the same time.

A breakdown of the samples appears in Table 1.

TABLE 1

| Sample No. | Kind of sample | Temperature distribution (°C.) | Rolling force (TON) |
|---|---|---|---|
| 1 | Example-1 | 20 | 30 |
| 2 | Example-2 | 30 | 30 |
| 3 | Comparative-1 | 40 | 30 |
| 4 | Comparative-2 | 50 | 30 |
| 5 | Example-3 | 30 | 40 |
| 6 | Comparative-3 | 30 | 20 |

The aluminum plates which were made in this way were used as planographic printing plate supports. Etching was conducted at a temperature of 50° C. with a 15% caustic soda solution so that the etching amount became 5 g/m$^2$. After washing, desmutting was conducted by dipping for 10 seconds into a 150 g/l, 50° C. sulfuric acid solution, and it was then washed again.

Furthermore, the support underwent electrochemical surface graining in a 16g/l nitric acid aqueous solution, using the alternating current described in Japanese Patent Unexamined Publication No. Sho-55-19191. As the electrolysis conditions, anode voltage $V_A$ was set to 14 volts, cathode voltage $V_c$ to 12 volts, and the quantity of electricity in the anode time was set to 350 coulomb/dm$^2$.

The substrates 1 to 6 produced in the above manner were coated so that the below-mentioned composition attained a coating amount of 2.0 g/m$^2$ after drying, thus providing the photosensitive layer.

| (The photosensitive solution) | |
|---|---|
| N-(4-hydroxyphenyl), methacrylamide/2-hydroxyethyl methacrylate/acrylonitrile/methylmethacrylate/ methacrylic acid (= 15:10:30:38:7 mol ratio) copolymer (average molecular weight 60000) | 5.0 g |
| Phosphate hexafluoride of condensate of 4-diazodiphenylamine and formaldehyde | 0.5 g |
| Phosphorous acid | 0.05 g |
| Dicutoriapeu Blue BOH (manufactured by Hodogaya Chemical Co., Inc.) | 0.1 g |
| 2-methoxyethanol | 100.0 g |

With regard to the photosensitive planographic printing plate produced in this manner, after conducting exposure for 50 seconds by a 3 kw metal halide lamp from a distance of 1 m through a transparent negative film in a vacuum printing frame, developing was conducted by a developer of the below composition and gumming was conducted with an arabia gum aqueous solution to produce the lithographic printing plate.

| (Developer) | |
|---|---|
| sodium sulfite | 5.0 g |
| benzyl alcohol | 30.0 g |
| sodium carbonate | 5.0 g |
| isopropyl naphthalene sodium sulfonate | 12.0 g |
| pure water | 1000.0 g |

Using the planographic printing plates obtained in the above manner, as a result of conducting printing in the normal sequence, the results of Table 2 were obtained.

TABLE 2

| Sample No. | 1 | 2 | 3 | 4 | 5 | 6 |
|---|---|---|---|---|---|---|
| Results of print | Good | Good | Not good | Not good | Good | Fair |

With regard to the same samples which performed the above-mentioned printing test, when their grained surfaces were observed by an electron microscope prior to the photosensitive layer application, it was found that No. 3 and 4 which proved deficient in the printing test had grains which were not uniform in the widthwise direction of the plate compared to No. 1, 2, 5, 6.

Furthermore, although not deficient in terms of the printing results, it was found with regard to No. 6 which proved somewhat inferior to No. 1, 2, 5 that the grain was somewhat irregular overall compared to No. 1 and 5.

EXAMPLE 2

Figure 2:
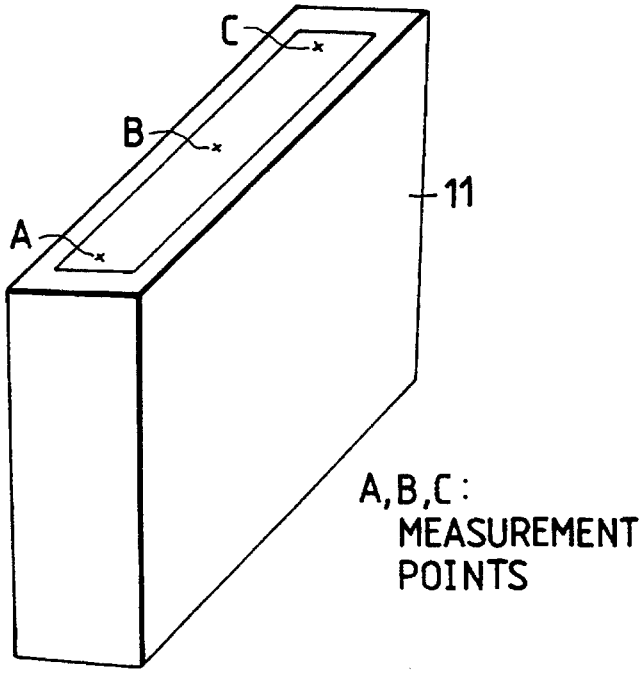
FIG. 2 shows measurement points of temperature distribution in the carbon mold which can be used in the casting process in the present invention.

Using the carbon mold shown in FIG. 2, a tabular slab of 10 mm thickness was produced. On this occasion, at the 3 points shown by A, B, C in the drawing, the molten metal temperature at the outlet of the molten metal supply nozzle (not illustrated) was measured. At this time, by suitably varying the heating conditions of the heating elements provided in the nozzle, samples 7 and 8 were produced under conditions where the temperature differences at the 3 points A, B, C fell within 30° C., and sample 9 under conditions where 30° C. was exceeded, thereby producing examples 4 and 5 of the present invention and comparative example 4. With regard to the slabs produced in this manner, cold rolling was performed to obtain plates of 0.3 mm thickness, and the distribution of the trace alloy components of the plate surface was studied by an electron beam microanalyzer. Furthermore, surface graining treatment identical to that of the Example 1 was conducted, and the uniformity of the surface was evaluated.

A breakdown of the samples is shown in Table 3, and the evaluation results in Table 4.

TABLE 3

| Sample No. | Kind of sample | Temperature distribution |
|---|---|---|
| 7 | Example-4 | 10 |
| 8 | Example-5 | 30 |
| 9 | Comparative-4 | 50 |

TABLE 4

| Sample No. | 7 | 8 | 9 |
|---|---|---|---|
| Alloy component distribution | Uniform | Uniform | Not-uniform |
| Surface quality evaluation | Good | Good | Not good |

With regard to the planographic printing plate produced according to the present invention in the above manner, compared to conventional products, the scattering in the material of the aluminum support has been reduced particularly in the widthwise direction of the plate, the yield of the electrolytic surface graining treatment has been improved, and printing performance is superior as a result of the superior surface graining aptitude.

Furthermore, there is also the major effect of reducing raw material costs due to the rationalization of the manufacturing process of the aluminum support, and, in particular, major contributions are made toward improving the product quality of the support for a planographic printing plate and cost reduction.

EXAMPLE 3

In the continuous casting device shown in FIGS. 6A to 6E, aluminum plate material with a plate thickness of 7.3 mm was formed, cold rolled to a thickness of 1.0 mm, and subsequently subjected to an annealing process in which the annealing conditions were varied as shown in the first half of Table 5. Thereafter, cold rolling was conducted to a thickness of 0.24 mm to form the sample.

TABLE 5

| Sample NO. | Kind of example | 1st time A | 1st time B | 2nd time C | 2nd time D | E | F |
|---|---|---|---|---|---|---|---|
| 10 | Exam. 6 | 60 | 600 | 0.5 | 600 | no irregularity | no generation of streak |
| 11 | Comp. 5 | 0.5 | 600 | 60 | 600 | granular irregularity | streak generation |

TABLE 5-continued

| Sample NO. | Kind of example | 1st time A | 1st time B | 2nd time C | 2nd time D | E | F |
|---|---|---|---|---|---|---|---|
| 12 | Comp. 6 | 0.5 | 600 | 0.5 | 600 | granular irregularity | streak generation |
| 13 | Comp. 7 | 60 | 300 | 0.5 | 600 | no irregularity | streak generation |

A: Temperature raising rate (°C./sec)
B: Peak temperature (°C.)
C: Temperature raising rate (°C./sec)
D: Peak temperature (°C.)
E: State of irregularity generated on the surface
F: State of streak generated on the surface The aluminum plates produced in this manner were used as supports for planographic printing plate. Etching was conducted at 50° C. with a 15% caustic soda aqueous solution so that an etching amount of 5 g/m$^2$ was reached. After washing, the plate was dipped for 10 seconds in a 150 g/l, 50° C. sulfuric acid solution for purposes of desmutting, and then washed.

Furthermore, placing the support in a 16 g/l nitric acid aqueous solution, electrochemical surface graining was performed using the alternating wave form current described in Japanese Patent Unexamined Publication No. Sho-55-19191. As the electrolysis conditions, the anode voltage $V_A$ was set to 14 volts, the cathode voltage $V_C$ to 12 volts, and the quantity of electricity at anode time was set to 350 coulomb/dm$^2$.

In order to evaluate conditions concerning the presence or absence of surface irregularities and the generation of streaks after treatment of the substrate manufactured in the above manner, an evaluation of external appearance was conducted.

As shown in Table 5, compared to conventional products, the planographic printing plate produced according to the present invention exhibits superior printing performance as a result of the improved yield of its electrolytic surface graining treatment and its superior surface graining aptitude. The generation of streaks as well as creased/granular irregularities on the treated surface is also eliminated, and the external appearance is markedly better.

Furthermore, there is also the major effect of reducing raw material costs due to the rationalization of the manufacturing process of the aluminum support, and, in particular, major contributions are made toward improving the product quality of the planographic printing plate and cost reduction.

The above embodiment used a twin-belt continuous casting device, but the present invention may also use a twin-roller continuous casting device to obtain the same effect. In particular, in the case where a twin-roller continuous casting device is used, a hot rolling machine becomes unnecessary, and the effect of production process rationalization is further heightened.

What is claimed is:

1. A method of producing a support for planographic printing plate comprising the steps of:

(a) supplying molten aluminum to a mold from a molten metal supply nozzle wherein a temperature gradient of the molten aluminum in the width direction of said molten metal supply nozzle is maintained within about 30° C. at a tip end of said nozzle;

(b) casting, in the mold, the molten aluminum into tabular aluminum;

(c) rolling, heat treating and correction of the tabular aluminum to obtain an aluminum support; and (d) graining a surface of the aluminum support.

2. The method according to claim 1, wherein said temperature gradient is maintained by measuring the temperature gradient of the molten aluminum in the width direction at the tip end of said nozzle; and controlling heating elements, which are provided near the tip of the nozzle and in a segmented manner in the width direction of the nozzle, on the basis of the measured value.

3. The method according to claim 1, wherein said mold includes a fixed mold.

4. The method according to claim 1, wherein said mold includes a drive mold.

5. The method according to claim 4, wherein said drive mold includes a pair of rolls and wherein said step (b) includes the step of simultaneously casting and rolling the molten aluminum using the pair of rollers to directly form from the molten aluminum the tabular aluminum in the form of a continuous thin plate capable of being wound on a coiler.

6. The method according to claim 5, wherein the continuous thin plate has a thickness of 4 to 30 mm.

7. The method according to claim 5, wherein in the step (b) a pressure applied by the pair of rolls is kept not lower than 30 tons per 1 m in a width direction of the thin plate.

8. The method according to claim 4, wherein said drive mold includes a pair of twin-belt continuous casting device and wherein said step (b) includes the step of casting the molten aluminum using the twin-belt continuous casting device, and hot rollers using a hot-rolling machine to directly form from the molten aluminum the tabular aluminum in the form of a continuous thin plate capable of being wound on a coiler.

9. The method according to claim 8, wherein the continuous thin plate has a thickness of 4 to 30 mm.

10. The method according to claim 1, wherein in the step (c) the tabular aluminum is rolled so that the thickness of the tabular aluminum is reduced by 60 to 95%.

11. The method according to claim 10, wherein in the step (c) the tabular aluminum is annealed at a temperature raising rate not less than 50° C./sec and an annealing temperature of 400° C. to 650° C., and subsequently annealed at a temperature raising rate not more than 10° C./sec, as the heat treating.

12. A method of producing a support for planographic printing plate comprising the steps of:

(a) continuous cast-rolling molten aluminum so as to directly form from the molten aluminum a thin plate of 4 to 30 mm;

(b) cold-rolling the thin plate to reduce the thickness thereof by 60% to 95%;

(c) annealing the thus thickness-reduced thin plate at a temperature raising rate not less than 50° C./sec and an annealing temperature of 400° C. to 650° C., and subsequently annealing the same at a temperature raising rate not more than 10° C./sec; and (d) rolling the thin plate thus subjected to the annealing in the step (c), to reduce thickness of the plate to 0.1 to 1.0 mm, to thereby provide an aluminum support.

13. The method according to claim 12, further comprising the step of:

(e) after the step (d), correction and surface-graining the aluminum support.

* * * * *